United States Patent [19]

Köbler et al.

[11] Patent Number: 4,828,242

[45] Date of Patent: May 9, 1989

[54] TRANSPORT SYSTEM FOR PAIRED SHEET ELEMENTS

[75] Inventors: Ingo Köbler, Anhausen; Godber Petersen, Augsburg, both of Fed. Rep. of Germany

[73] Assignee: MAN Roland Druckmaschinen AG, Offenbach am Main, Fed. Rep. of Germany

[21] Appl. No.: 60,764

[22] Filed: Jun. 10, 1987

[30] Foreign Application Priority Data

Jun. 28, 1986 [DE] Fed. Rep. of Germany ..... 3621834

[51] Int. Cl.[4] ..... B65H 39/02

[52] U.S. Cl. ..... 270/54; 270/58; 271/204; 226/170; 226/173

[58] Field of Search ..... 270/39, 54, 55, 57, 270/58; 271/204, 206; 226/170, 173

[56] References Cited

U.S. PATENT DOCUMENTS

| | | | |
|---|---|---|---|
| 3,122,362 | 2/1964 | Vollrath et al. | 270/55 |
| 4,046,367 | 9/1977 | Merker et al. | 270/55 |
| 4,201,286 | 5/1980 | Meier | 271/206 |
| 4,723,770 | 2/1988 | Seidel et al. | 270/55 |

FOREIGN PATENT DOCUMENTS

| | | | |
|---|---|---|---|
| 2140773 | 12/1973 | Fed. Rep. of Germany | 271/293 |

*Primary Examiner*—Robert E. Garrett

*Assistant Examiner*—Therese M. Newholm

*Attorney, Agent, or Firm*—Frishauf, Holtz, Goodman & Woodward

[57] ABSTRACT

To move a plurality of interconnected segments which a zig-zag, accordeon or bellows pleat arrangement on or between which sheet elements such as projecting elements from a folded sheet are located along a transport path and to permit, selectively, expansion or compression of the segments for handling of sheet elements, and compact storage, an endless belt, preferably a gear belt sprocket chain or the like, is provided engageable with the segments. Preferably, lifting rollers are provided, selectively engageable with the belt to slightly raise the segments from transport rails, and decrease friction of the segments with respect to the rails. The segments can be stored, when empty or loaded, when collapsed against each other, and spread apart for sheet material handling. A plurality of such system can be located or adjacent each other, so that, when the segments are spread apart, suitable mixing or insertion steps can be carried out. To permit a space-saving arrangement, the transport path can be sinuous, with 180° rotating elements, having carrying rods engaging the segments coupled to a disk, turning the segments about an arcuate path defined by the travel of the carrying rods on the disk. The segments can be raised, again, by placing a cam track adjacent the disk, on which the carrying rods can run off by means of cam follower rollers.

22 Claims, 9 Drawing Sheets

TRANSPORT SYSTEM FOR PAIRED SHEET ELEMENTS

Reference to related applications, assigned to the assignee of the present invention, the disclosure of which is hereby incorporated by reference:

U.S. Ser. No. 056,786, filed May 29, 1987, Kobler et al

U.S. Ser. No. 056,857, filed May 29, 1987, Kobler et al

U.S. Ser. No. 056,857, filed May 29, 1987, Kobler et al now U.S. Pat. No. 4,807,86

U.S. Ser. No. 056,787, filed May 29, 1987, Petersen now U.S. Pat. No. 4,775,13

U.S. Pat. No. 4,465,269, Petersen, and

U.S. Pat. No. 4,605,212, Kobler, both assigned to the assignee of the present application, the disclosures of which are hereby incorporated by reference.

The present invention relates to article handling apparatus, and more particularly to paper handling apparatus, or more generally to appratus for handling sheet-like substrates, especially printed material such as printed paper and the like; and more particularly to transport apparatus in which folded sheets or bundles of sheets define a fold or spine, which may be partly or entirely creased, and from which sheet elements extend; the sheet elements may, however, also be unconnected.

BACKGROUND

Various types of transport systems, especially intended for printed substrates and most particularly for folded printed substrates, are used essentially only to transport the sheet elements. As an example, folded sheets or groups of folded sheets, or individual sheets may be transported from a folding apparatus to a storage arrangement or system in form of a storage stack or a storage roll, which may have vanes. The storage system is entirely independent of the transport system. For further handling of stored sheet elements, which may be connected, that is, be in form of folded sheets, it is nececessary to use additional accessories if it desired to insert, for example, special editions, announcements, advertising material and the like. A typical application are newspapers, magazines, periodicals and the like, which are to have special inserts, for example special regional editions or advertising material. To apply such inserts, it is necessary to open the already assembled folded sheets, groups or bundles of sheets, or sheet elements. Frequently, an overhang or overfold is provided to permit such opening. This increases the paper use and requirement. Such known transport and storage systems are space-consuming and, overall, voluminous. They are difficult to integrate in automated systems in further handling of the substrates, that is, typically the paper sheets, folded sheets or groups of sheets, or the like.

THE INVENTION

It is an object to provide a transport system which can be integrated with a storage system, particularly adapted to transport and store paired sheet elements or stacks of paired sheet elements, and especially suitable to transport and store folded sheets or stacks or groups of folded sheets in such a manner that applying inserts is simple and can be carried out without the respectively stored sheet elements leaving or being removed from the storage and transport system.

Briefly, a plurality of segments, especially in plate-like form, are interconnected to form zig-zag or accordeon pleats, capable of being selectively expanded or contracted. When expanded, at least a portion of the segments are spaced from each other; when contracted, the segments are compressed towards each other, in essentially parallel position, thus taking up little space. Folded sheets, or groups or bundles of sheets folded along a fold line or spine hang from the segments, or are placed between segments. Guide means are provided, engaging the segments to guide the segments in a predetermined path, which may include storage sections or positions, insertion and mixing sections and positions, holding positions and the like, and, further, storage positions for empty segments for later loading with sheets or sheet elements. Transport means are located at least at one extreme end of the segments, for example at the top or bottom, and along at least a portion of the predetermined path, engageable with the segments, for moving the segments in the predetermined path, for example between the respective locations or positions at which paper handling, expansion and compression of the segments, and the like, is to take place.

DRAWINGS

DEFINITION

When reference is made hereinafter and in the claims to "sheet", it is to be understood that the singular form is used merely for convenience and is deemed to include packages of sheets, for example numerous folded sheets, e.g. newspapers. The apparatus is especially suitable for paper sheets, but can be used, also, with other sheet material, for example plastic films, fabric and the like.

DETAILED DESCRIPTION

A plurality of segments 1, for example of sheet metal, cardboard, hardboard, plastic or the like, are connected in zig-zag manner, to form a zig-zag group of array of such segments, which can be expanded or contracted. The general shape is zig-zag or accordeon or bellows pleated. The individual segments are connected at their extreme ends, for example by being bonded together; if of sheet metal, typically sheet steel, they may be connected by spot-welding; if of plastic, living hinges can be used to form one interconnected group of segments. Otherwise, hinges, typically of the "piano hinge" type, are suitable. Such zig-zag, accordeon or bellows pleated structures made of segments 1 can be expanded or compressed by being pulled or pushed along guide rails 14. When compressed, compact storage of sheet elements located in the pockets defined by adjacent segments is possible; empty segments also take up little space and can be compressed against each other; when pulled apart, however, or expanded, it is easily possible to carry out mixing and insertion steps between sheet elements located in the pockets defined by the segments. For example, folded sheets with depending sheet elements are placed on the top ends of the segments, to hang thereover like a roof structure. Upon pulling apart of the segments 1, folded sheets on or in the pockets defined by the segments likewise will be spread apart. If the sheet elements are so arranged that their spine or fold or crease line is on top, they will necessarily be spread; if they are located in the pockets defined by the segments, so that the spine or fold or crease line, if present, is at the bottom, clips of resilient material which engage between the sheet elements projecting from the spine or fold line and located adjacent the other extreme of the segments—see clips 38, 39, FIG. 6—will spread apart the sheet elements projecting upwardly as the segments are expanded. Thus, likewise, the sheet elements will be spread apart to permit placement of inserts and the like.

Various types of segments, and the possibilities of placement of folded sheets or sheet elements therein or thereon, are shown and described in copending application Ser. No. 056,786, filed May 29, 1987, Kobler et al.

Figure 1:
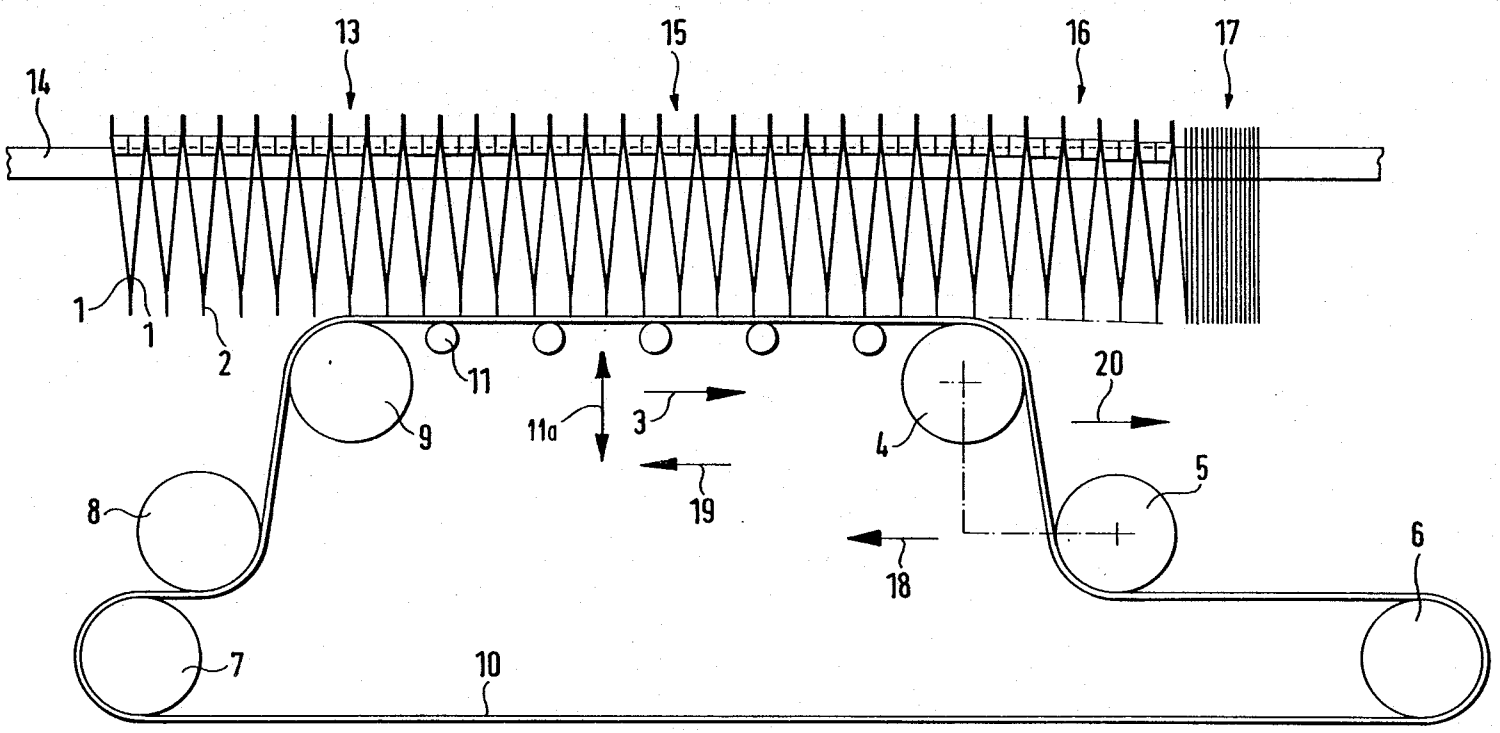
FIG. 1 is a schematic side view of a transport system including, inherently, storage capability.

FIG. 1 shows a general zig-zag arrangement of sheets elements 1, connected at their extreme ends and assembled to form a combined sheet transport and storage system 2. The sheet transport and storage system 2 is movable in the direction of the arrow 3, for example so that it can be shifted to a storage region—not further specifically identified. Along a transport path, the segments 1 are spread apart or expanded, so that folded sheets or sheet elements can be placed in the pockets or divisions defined by the respective segments.

In accordance with a feature of the invention, a transport apparatus, or transport means is provided which is formed by an endless belt, chain or sprocket arrangement 10, guided over deflection rollers 4, 5, 6, 7, 8 and 9. It is possible to change the length of the transport path, for example by expanding or extending it towards the left, in dependence on the number of segments to be filled, and the storage capacity of the overall system, by retaining or journalling at least one of the rollers so as to be movable and expanding the length of the transport path. FIG. 1, schematically, illustrates in the broken-line connection between the centers of rotation of the rollers 4 and 5, the possibility of shifting the rollers 4 and 5 in the direction of the arrows 18 or 20, respectively. Roller 5 forms a belt length compensation roller which is shifted simultaneously with shifting of the roller 4. Of course, and depending on the width of the segments 1 in a dimension perpendicular to the plane of the drawing, a plurality of belts, chains, ribbons or other similar transport elements can be located laterally adjacent each other, or the width of the respective transport element 10 can be suitably chosen so that the segments 1 are reliably engaged. In accordance with a preferred feature, rollers 11 are provided between the rollers 4 and 9, preferably movable between the position shown in FIG. 1 and a somewhat dropped position. Rollers 11 then will function as support rollers. For shifting of the segments 1 or, respectively, the transport system 2 as a whole, it is desirable to lift the segments 1 slightly so that the weight thereof loads the belts 10 along the path of movement. This lifting of the system 2 occurs, when movement is in direction of the arrow 3, on the roller 9 in the region 13 (FIG. 1). This slightly lifts the segments upwardly from rails 14, which then will function essentially only as lateral guide elements, so that friction, particularly at higher transport speeds, between the rails 14 and the segments 1 will not become high, especially if the transport speed in the region 15 is high. If storage is to be carried out, for example of empty or filled segments, by compression of the segments 1 towards each other, the transport and storage system 2 is permitted to drop off the support rollers 11 in the region 16, by being released from the roller 4, so that the segments 1 will be suspended from the rails 14. In the section 17, the segments can then be completely compressed towards each other, thus providing for compact storage of numerous folded sheets, sheet elements and the like between or on the segments.

The axes or shafts of the rollers 4, 5 can be securely connected together and, in dependence on the feeding speed of sheets on the segments 1 in the region 15, moved in the direction of the arrow 18 or 20, respectively. The other rollers, 6 to 9, remain axially fixed, for example by having their shafts secured to the frame of the entire structure—omitted from the drawing for clarity and of any suitable construction. Upon reverse of the feed, for example feeding in the direction of the arrow 19 of FIG. 1, rollers 4, 5 are moved in the direction of arrow 20. This engages the belt or similar structure 10 against the segments 1 in a position close to the storage region 17, removing segments 1 from the region 17 and, gradually, pulling apart the segments 1 so that they will open. In the region 16, the segments 1 are again lifted slightly, and, as lifted slightly by upward raising of the rollers 11, for example by any suitable upward lifting apparatus which may be mechanical, pneumatic, hydraulic or the like, they can be transported, as raised, in the region 15 in the direction of the arrow 19. In accordance with the longitudinal movement of the segments 1, the rollers 11 are again permitted to drop, so that the segments can again engage the rails 14 to be suspended thereon. The axes of the shafts 11 may carry out vertical up-and-down movement, pivoting movement, or the like, as desired. Specific apparatus to move the axes of the rollers 11 has been omitted from the drawing because it can be of any suitable construction. Movement of the axes of the rollers 11 is merely indicated, schematically, by the arrow 11*a*.

Figure 2:
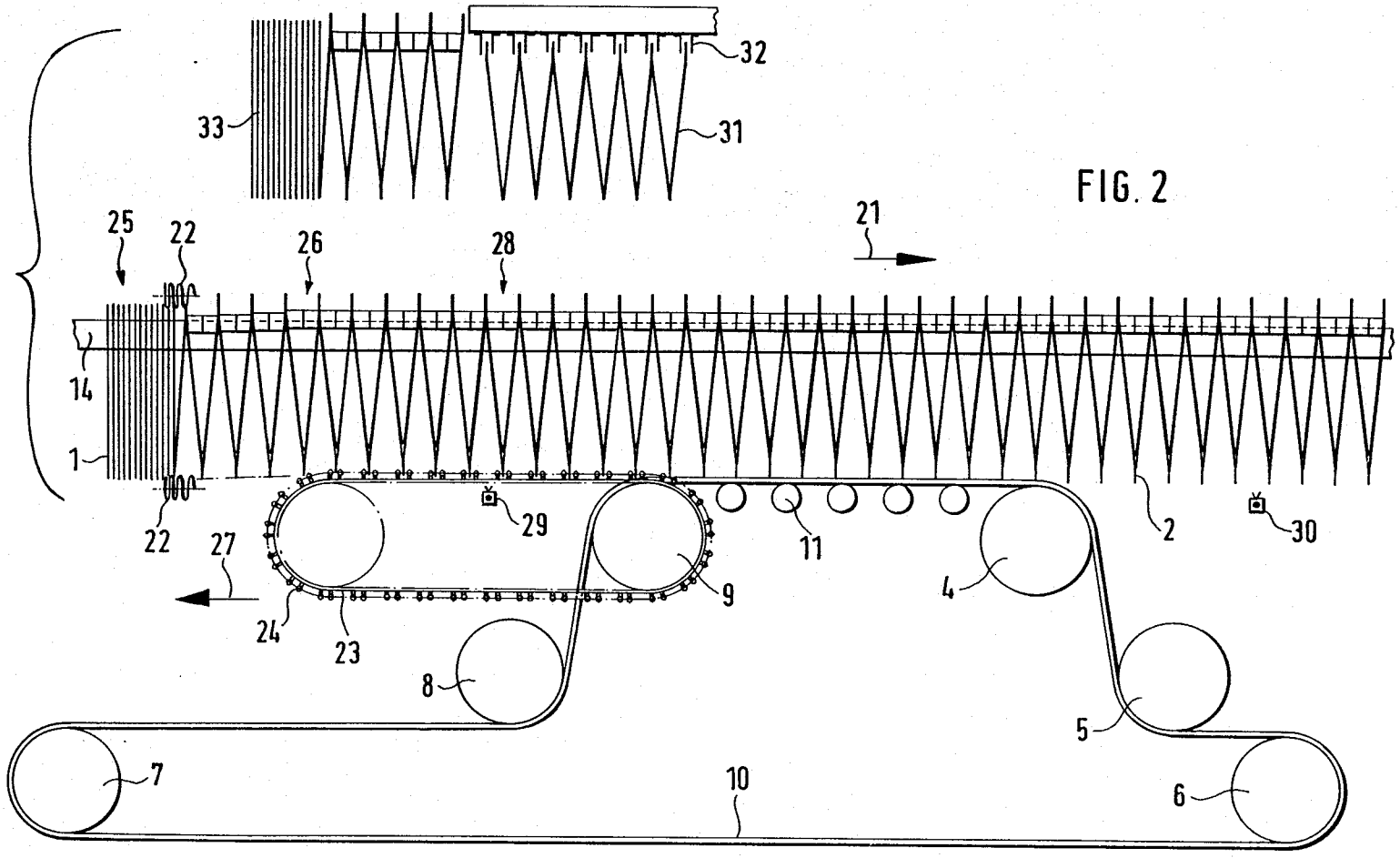
FIG. 2 is a fragmentary enlarged view of a portion of the system of FIG. 1, additionally illustrating a transport arrangement for timed guidance of sheet elements.

FIG. 2 illustrates the transport system for synchronized transport of two storage systems, for example suitable for transfer of sheet elements from a first transport system to a second one, so that sheet elements or folded sheets can be transferred between the systems in precisely predetermined defined positions.

The general structure of the transport system is similar to that described in connection with FIG. 1. For synchronized spreading-apart and operation of the system, including removal of segments 1 from a storage section 25, at least one, and preferably two worms 22 are used. In the embodiment shown in FIG. 2, two worms 22, respectively, engage the segments 1 for precise expansion of the segments to form the storage and transport system 2, and move the segments in the direction of the arrow 21. Preferably, each one of the worms 22 has a pitch which increases in the direction of the arrow 21, so that the end, that is, the greatest distance between adjacent worm lands, will conform at least approximately and preferably closely to the distance of carrying elements 24, secured to a gear belt 23. The carrier elements may be in form of engagement dogs.

Let it be assumed that the storage system formed by the plurality of segments which, in FIG. 2, are located at the left side, is to be moved towards the right, in the direction of the arrow 21. Thus, the compressed segments 1 are to be expanded. To do so, the worms 22 engage between the compressed segments and pull or expand the segments apart and away from each other when the worms are rotated. This permits synchronized supply to the carrier dogs 24 on the endless gear belt 23. At the same time, the system 2 is slightly lifted upwardly, but is generally constructed as explained above. The worm 22 as well as the gear belt 23, and the rollers 8, 9, thus operate as a connected synchronized system in the direction of the arrow 27 with the removal speed of the storage system, as determined by the respective operating speeds of the respective elements.

If it is desired to continue to transport the segments 1 beyond the region 28, the system 2 can be dropped from the gear belt 23 on the belts or transport chains or tapes 10 and carried onwardly thereby, as explained in connection with FIG. 1. The spacing between the movable roller 9 and the fixed roller 4—reversed in the example of FIG. 2 with respect to that of FIG. 1—will increase, so that additional support rollers 11 are desirable in order to insure reliable separation of the segments 1 from the rails 14, as shown in FIG. 2.

Misfeeds and malfunction are unfortunately always a source of concern. If, for example, the pockets defined by some of the segments are empty, it is possible to insert replacement sheets or sheet elements from above. If an empty pocket is sensed, for example by a sensor 29 (FIG. 2) and located, for example, in the region 28, it is possible to move the segment which is empty, that is, has a fill gap, with reduced speed until it reaches a sensor 30. The number of missing sheets or sheet elements can readily be determined by the sensor. Such sensors, for example of the optical type, are well known and may be of any suitable construction. The transport is then stopped and the required additional sheets or sheet elements 31 are inserted by placing a gripper arrangement 32 in position over the missing sheet elements in the storage system 2, for placement in the storage system 2. The storage system 33, positioned above the storage system 2, can be identical to that of storage system 2, with the grippers being arranged to remove the respective sheets or sheet elements and permitting them to drop in or on the respective segments 1 of the system 2. FIG. 2 illustrates the arrangement expanded and schematically. The sheet elements 31 can drop on or between segments 1 thereunder. At another position, for example along the direction of the arrow 21, suitable buffer zones may be formed so that the system as a whole can continue to operate at the operating speed for which it is designed, with only individual segments of the accordeon-pleat array or assembly of segments being retarded in their movement.

FIGS. 3 to 6 illustrate another arrangement which permits transfer of sheet elements 36, 37 into or adjacent each other; in other words, it permits mixing of sheets or sheet elements 36 and 37, for example for placement of regional editions, advertisement material and the like, within already folded, but now expanded newspapers to permit the insertion.

Two storage systems 2, 2' are provided; the systems can be identical in all respects, and the same reference numerals have been used for both systems, one of them, however, with prime notations.

Figure 3:
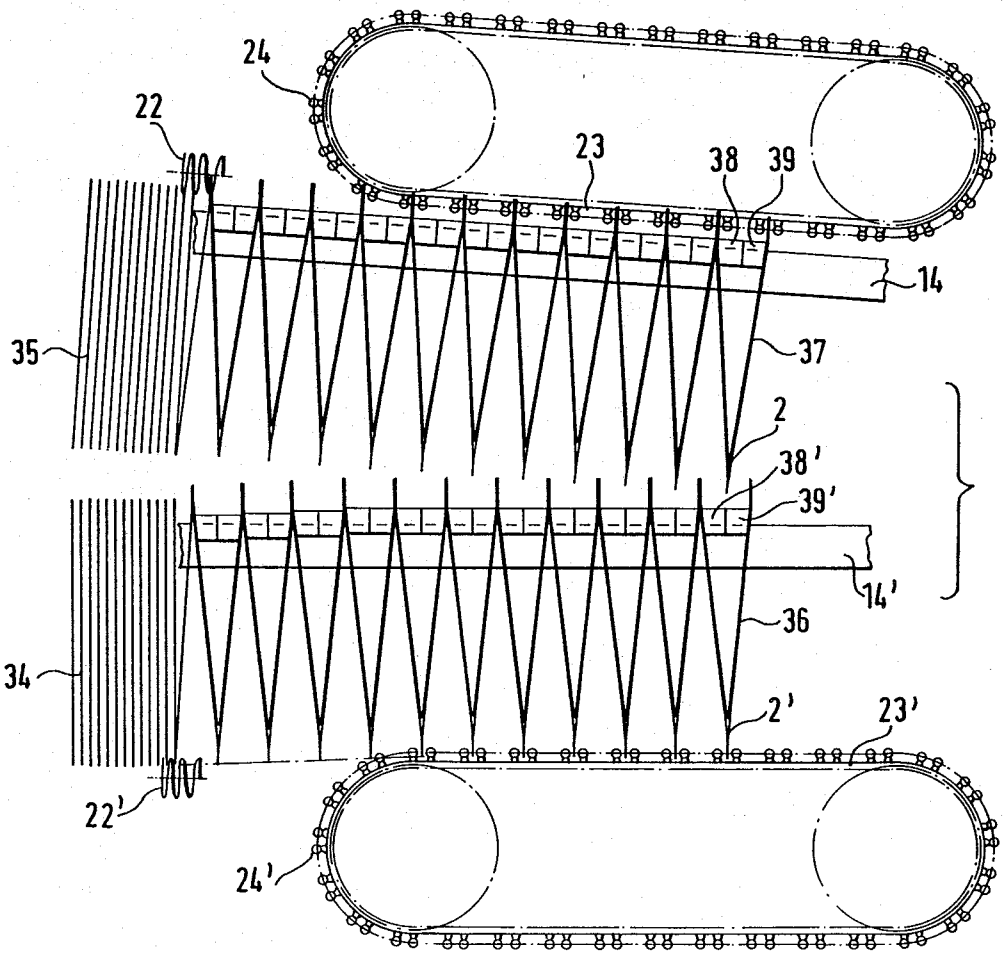
FIG. 3 is a schematic side view illustrating an arrangement for mixing and transferring sheet elements.
Figure 5:
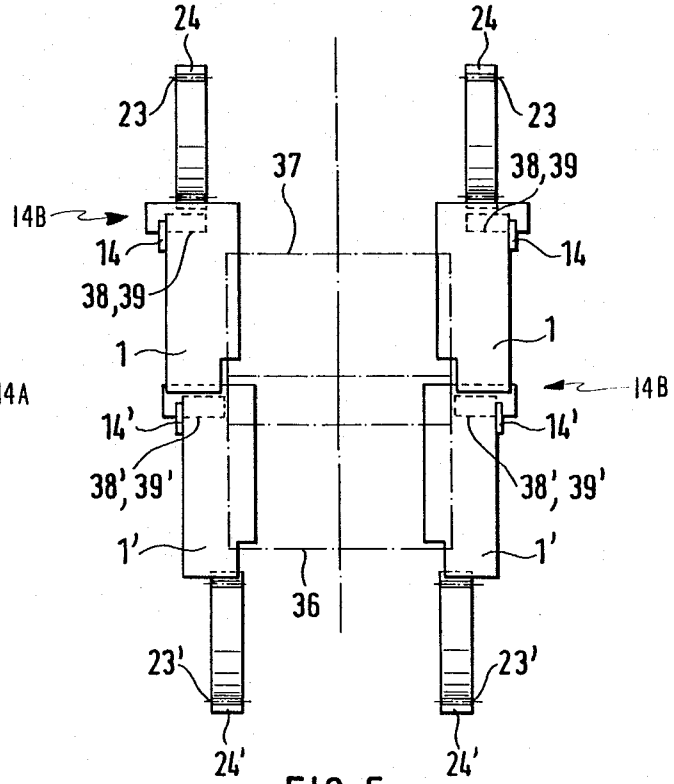
FIGS. 4 and 5 are schematic fragmentary end views illustrating sequential steps during insertion of sheet elements from one storage system into another.
Figure 4:
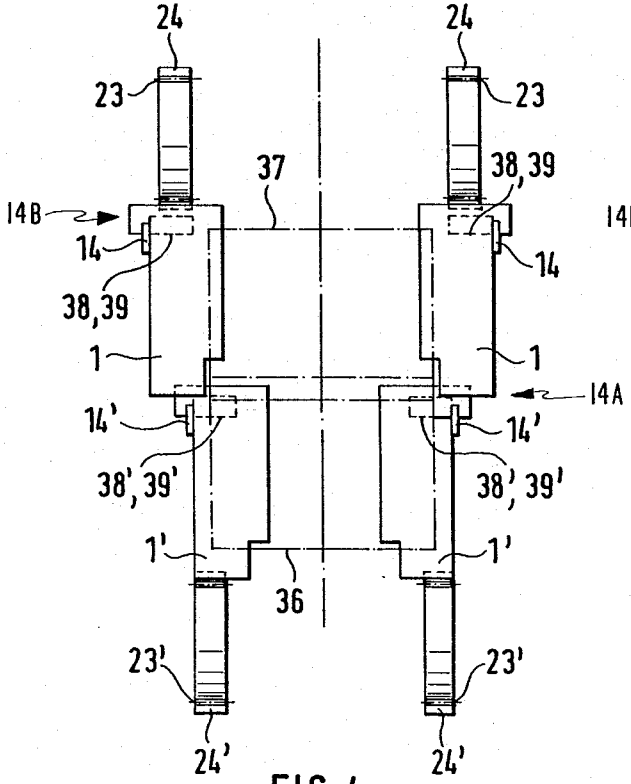
Figure 6:
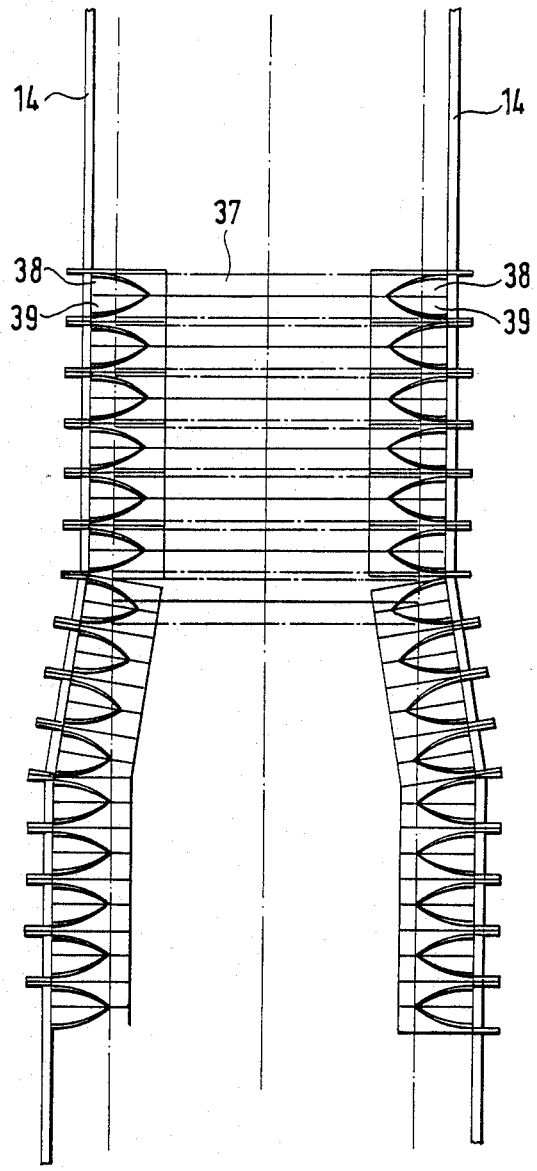
FIG. 6 is a schematic top view showing guidance of segments in a path which permits transfer of sheet elements from one storage system to another.

Two storage systems 2, 2', located above each other, permit transfer of folded sheets or sheet elements 36, 37 from or to storage regions 34, 35. The two transport and storage systems 2, 2' operate in synchronism, and are so synchronized with respect to each other that the upper system 2 engages within the open folded sheets or between sheet elements 36 which are located between segments of lower system 2'. Tongues or clips or holding elements 38, 39 of resilient springy material, e.g. sheet metal, shaped as shown in FIG. 6, engage between folds or spines of folded sheets or against sheet elements which open upon spreading apart of the respective segments. The steps in the insertion are best shown by reference to FIGS. 4 and 5. The upper transport system 2, as best seen in FIG. 6, is guided on rails which diverge at region 14B so that the folded products 37 from the upper system 2 are released to drop, by gravity downwardly, as best seen in FIG. 4, and fall into the open sheets 36 in the lower system 2' at least up to the tongues 38', 39'. Thereafter, the rails 14' of the lower transport system 2' are likewise spread in a manner similar to that shown in FIG. 6, region 14B, so that the sheets or sheet elements 37 from the upper system 2 can drop fully within the now spread-apart sheets 36 of the lower system 2'. Thereafter, and by bringing together the rails 14, to the their narrowed position shown at region 14A in FIG. 6 from the expansion of region 14B of FIG. 6. The sheets or sheet elements 36, with the sheet or sheet elements 37 now inserted therein can be transported further along the transport path as desired and as will be explained below. The transport gear belts 23, 23' can, of course, engage the segments at either extreme end, at the top or bottom, as shown in FIG. 3.

Figure 7:
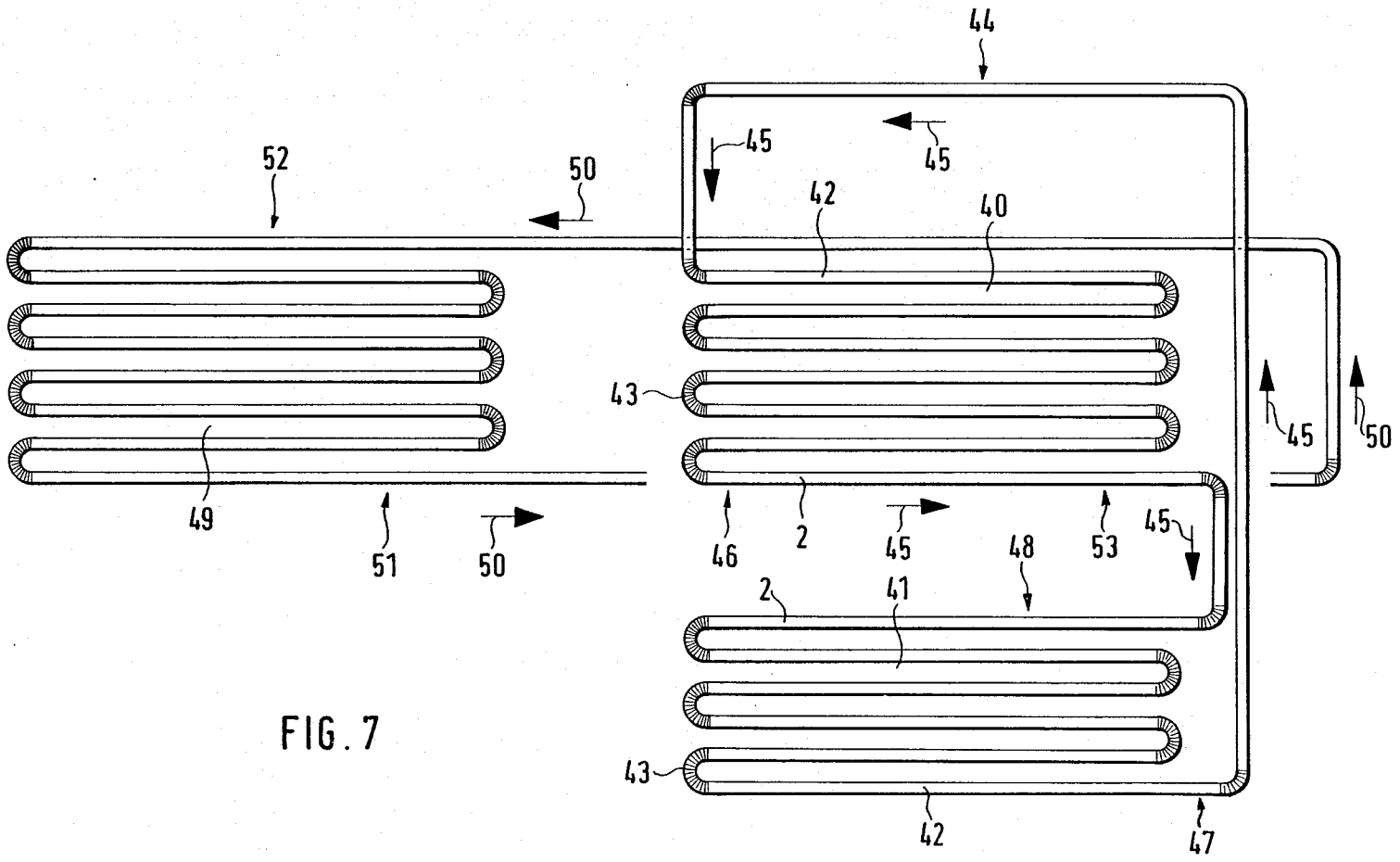
FIG. 7 is a schematic diagram illustrating a possible layout of a system for transporting and storing sheet elements.

A complete transport and storage system using endless belts, and permitting different operating speeds at different locations, to permit different paper or sheet handling at different locations, is shown in FIG. 7.

The system 2, as illustrated in FIG. 7, has storage regions 40, 41 which are arranged in two sinuous or zig-zag paths, formed by straight transport path elements 42 and curved turning structures 43 moving the segments 1 in a 180° turn.

In one example, region 44 is a loading region from which, for example from a printing machine, folded sheets or printed sheet elements are supplied, for further transport and storage in the direction of the arrow 45. The individual segments are expanded in the region 44, to provide the transport systems 2, 2', respectively. When the storage region 40 is reached, the segments will compress. The operating speed in the region 46 is less than the supply speed in the region 44. The storage region 41 is provided for storing empty systems 2, with the segments 1 essentially compressed. The store 41, thus, additionally operates as a buffer. Removal of segments in the region 47 is higher than the supply in the region 48. The storage region 49 retains the sheets or sheet elements which were supplied at 44, and removed in the region 46. The supply or feed speed in the direction of arrows 50 and 45 is the same. As described above, the supply and storage systems are guided above each other for transfer of sheet elements therebetween. FIG. 7 merely shows the arrangement in plan view. The storage region 49 also operates as an endless supply and storage system. The filled system, that is, segments filled with sheets or sheet elements, are removed from the region 51, emptied in the region 46, and then recycled or returned to the region 52. The system from the storage region 40, for example constructed similar to the system described in connection with FIG. 3, is loaded with sheets or sheet elements 36 and receives sheet elements 37 in the region 46. Unloading is carried out in the region 53 so that, as described above, the empty segments of the system can then be applied to the region 48 for storage of empty segments.

Figure 8:
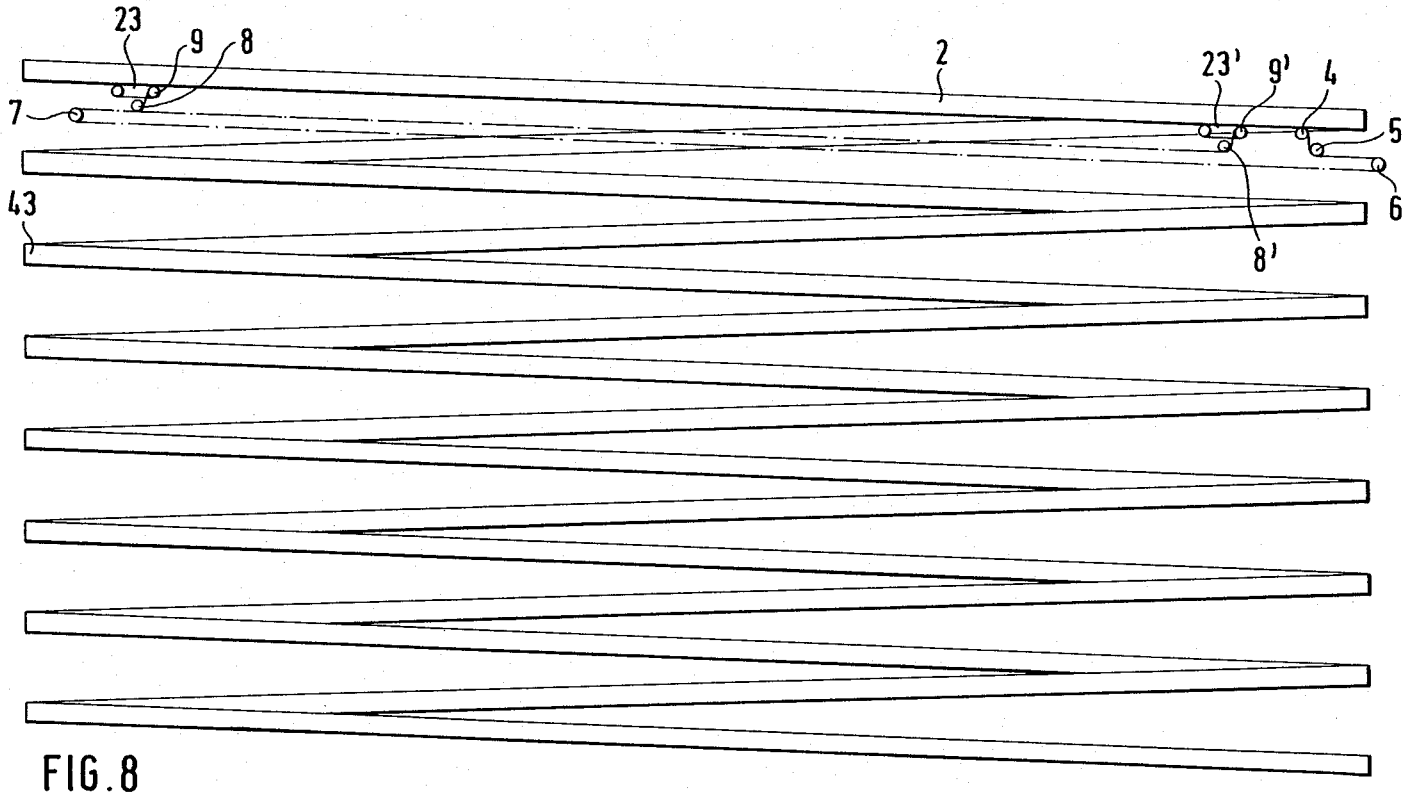
FIG. 8 is a side view of a storage portion having linear and curved sections.

FIG. 8 is a schematic side view of any one of the storage regions 40, 41, 49 described in FIG. 7. Each one of the systems 2, which are all above each other, have rollers 4, 5, 6, 7, 8, 9, belts 10 and gear belts 21. The final position is shown at 8', 9', 23'. At the ends thereof, the curved transport element 43 adjoins, for transport in curved paths.

Figure 9:
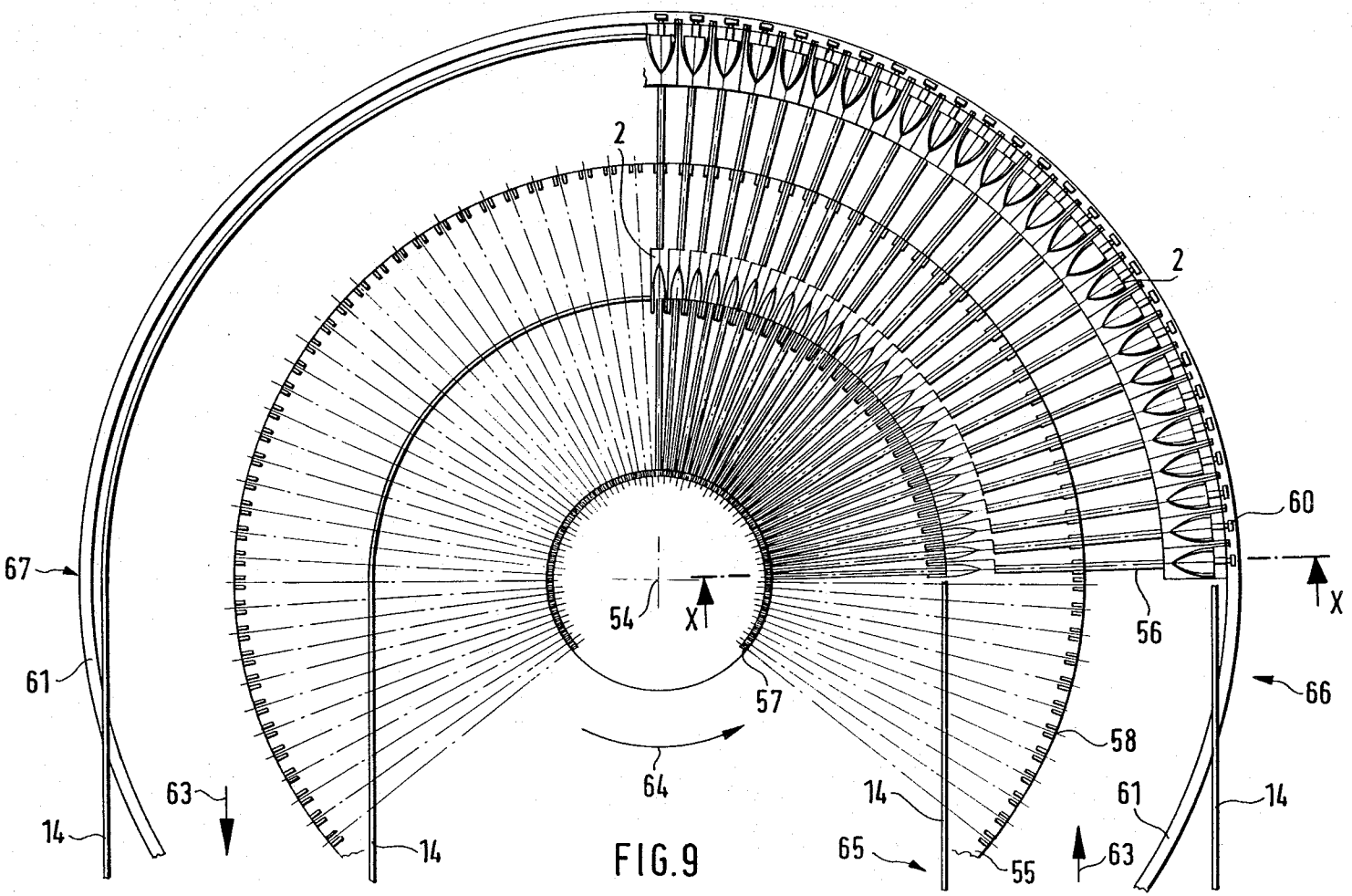
FIG. 9 is a top view of a portion of the system of FIG. 7 and illustrating moving segments in a circular path.
Figure 11:
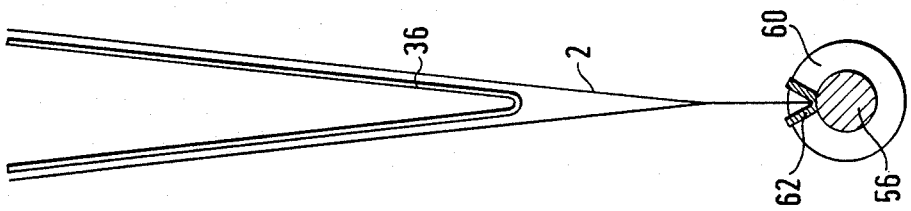
FIG. 11 is a section along line II—II of FIG. 10.
Figure 10:
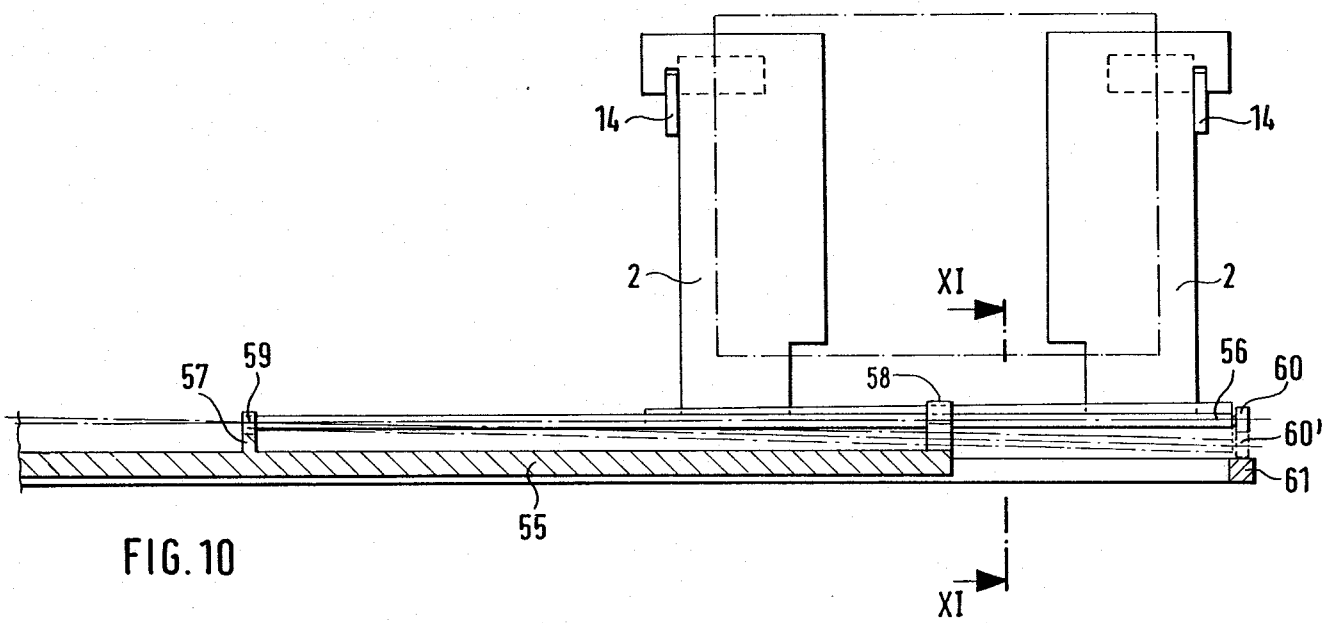
FIG. 10 is a section along line I—I of FIG. 9.

FIGS. 9 to 11 show a curved path transport system in accordance with a preferred construction. A rotating disk 55, rotating about a center 54, supports rod-like carry and transport elements 56, retained in a retaining ring 57, and carried along by carry elements 58.

FIG. 10 illustrates a section along line I—I of FIG. 9, and clearly shows that the carry elements 56 are pivotable about the pivot point 59 in the ring 57. They can slide up and down in the guides 58. This movement is scanned by rollers 60, located at the ends of the rods 56 (see FIG. 11) and running on a cam track 61. FIG. 11 is a section along lines II—II of FIG. 10, showing that each of the elements 56 has a funnel-shaped receiving region 62 to permit reception of segments 1 of the system 2. As seen in FIG. 9, the system 2 is turned around by 180° by the structure 43. The system 2 follows in accordance with suitably shaped rails 14. When the segments 1 of the system 2 reach the turn-around 43, they are more expanded at the outer portion than at the inner portion of the bend. The circumferential speed of the carry elements 58 at the outer edge of the disk 55 corresponds to the linear transport speed in the direction of the arrow 63. Upon rotation of the disk 55 in the direction of the arrow 64, the carry elements 56 in the region 65 will be at the lower position of the cam track 60' in FIG. 10. They engage beneath the segments of the system 2, to then lift the segments in the region 66 (FIG. 9), as seen, for example, at position 60, FIGS. 9, 10. After rotation by 180°, the sections 1 of the system 2 are again lowered in the region 67 (FIG. 9) permitting dropping of the sections 1 on the rails 14. The roller 60 then remains lowered. When the respective roller 60 of any one of the carry elements on the rods 56 again reaches the region 66, it remains in the lower position 60', to then again be able to lift the respective elements 1 of the system 2 which then appear at the range 66.

Various changes and modifications may be made, and features described in connection with any one of the embodiments may be used with any others, within the scope of the inventive concept.

We claim:

1. Folded sheet transport system, particularly folded sheets received from printing machinery, said folded sheets defining a fold line or spine, comprising a plurality of carrier segments (1) defining upper and lower regions and connected alternately at the upper and lower regions to form a segment array or assembly of zig-zag or accordion or bellows pleat form capable of being selectively, in longitudinal direction of the array or assembly, resiliently spread apart or expanded and compressed, and supporting the folded sheets by engagement with the fold line or spine and, upon spreading apart of said segments, likewise spreading the folded sheets supported by the segments;

support and guide means (10, 11, 14, 60, 62) for supporting said connected segments and for guiding said supported segments in a predetermined path; and transport means (10, 23, 56) located at and engageable with at least one extreme end of a plurality of the segments in the array or assembly along at least a portion of said predetermined path for moving said segments at least in said portion of said predetermined path.

2. The system of claim 1, wherein the transport means comprises an endless transport device including at least one endless belt, chain, sprocket belt or gear belt, having an upper run and a lower run extending at least in part along said portion of the predetermined path, and wherein one of the runs of said transport device is engageable with an extreme end of the segments.

3. The system of claim 2, further including carrier dogs (24) located on the endless transport means (23), and positioned for engagement of a segment between said dogs.

4. The system of claim 2, further including guide pulleys or rollers (4–9) about which said endless transport means is being guided;

and wherein at least one roller (4) is movable along said portion of the predetermined path, and another (5) of said rollers is movable with respect to the other rollers to provide for path length compensation of said endless transport means.

5. The system of claim 1, wherein the support and guide means include guide track means (14); and a plurality of lifting rollers (11) are provided located beneath an upper run of the endless transport device which is in engagement with the segments (1) for slightly lifting the segments to reduce friction of the segments with respect to the guide track means, said lifting rollers (11) being selectively movable upwardly and downwardly for selective lifting of said upper run of said transport device in selected positions along said predetermined path.

6. The system of claim 1, further including at least one transport worm (22) engageable with the interconnected segments and positioned in a region of transition between segments located in said predetermined path which are compressed, and segments which are to become expanded or spread apart, said at least one worm having increasing pitch in the direction towards which the segments are to become expanded.

7. The system of claim 1, wherein two of said transport systems (2, 2') are provided, one (2) located above the other (2');

at least the upper system (2) being arranged to supply sheets to the lower system (2').

8. The system of claim 7, wherein the sheets supplied from the upper system (2) to the lower system (2') are inserted between spread-apart folded sheets (36) already located on the lower system (2').

9. The system of claim 7, wherein the segments of said lower transport system are movable in said predetermined path; and said predetermined path includes a storage section (17) in which, after insertion of sheets into the lower system, the segments are compressed for compact storage of the sheets between the segments.

10. The system of claim 1, wherein said transport path includes a curved portion;

and wherein said transport means comprises a disk (55) rotating about a center (54), and carrier dogs (56) coupled to the disk and engageable with the segments to move the segments in an essentially circular path upon rotation of the disk.

11. The system of claim 10, wherein the carrier dogs include support elements (60) engageable with the segments;

and means (60, 60', 61) for raising the carrier dogs upon engagement of segments with the carrier dogs.

12. The system of claim 11, wherein the raising means comprises an essentially circular cam track (61).

13. The system of claim 1, wherein said predetermined path includes storage sections and transport sections, which sections have at least one of: straight portions and curved portions (40, 41, 49); and wherein transfer stations (44, 46, 48) are provided, positioned in linear or straight path portions for, selectively, loading, unloading, and mixing of sheets.

14. The system of claim 1, wherein said predetermined path has a path portion or region (15) in which said segments (1) are spread apart; and said transport means (10, 23, 56) engages said spread-apart segments in said path portion or region (15) and transports said segments in spread-apart condition through said region.

15. The system of claim 14, in combination with folded sheets supported by engagement of the fold line or spine of the sheets with the segments; and wherein, upon spreading of the segments, the folded sheets supported thereby are likewise spread and transported through said region (15) of said transport path.

16. The system of claim 14, in combination with folded sheets supported by engagement of the fold line or spine of the sheets with the lower region of the carrier segments (1); and including means (38, 39) for retaining the folded sheets in spread-apart condition within the segments, said retaining means (38, 39) comprising converging spring clips secured to the upper regions of the carrier segments.

17. The system of claim 14, in combination with folded sheets supported by engagement of the fold line or spine of the sheets with the upper regions of the carrier segments for hanging the folded sheets in roof-like or inverted V-shape over the segments, said folded sheets, upon spreading of the segments, likewise being spread apart and transported through said region (15) of said transport path.

18. The system of claim 1, in combination with folded sheets supported by engagement of the fold line or spine of the sheets with the segments;

wherein said predetermined path has a path portion or region (15) in which said segments (1) are spread apart; and wherein said transport means (10, 23, 56) engages the spread-apart segments in said path portion or region (15) and transports said segments in said spread-apart condition through said path portion or region with said folded sheets supported by said segments in spread-apart condition.

19. The transport system of claim 1, wherein said transport means includes a moving surface (10) positioned for frictional engagement with at least one of said extreme ends of the plurality of segments.

20. Folded sheet transport system, particularly folded sheets received from printing machinery, said folded sheets defining a fold line or spine, comprising a plurality of carrier segments (1) defining upper and lower regions and connected alternately at the upper and lower regions to form a segment array or assembly of zig-zag or accordion or bellows pleat form capable of being selectively, in longitudinal direction of the array or assembly, resiliently spread apart or expanded and compressed, and supporting the folded sheets by engagement with the fold line or spine and, upon spreading apart of said segments, likewise spreading the folded sheets supported by the segments;

support guide means (10, 11, 14, 60, 62) for supporting said connected segments and for guiding said supported segments in a predetermined path;

transport means (10, 23, 56) located at and engageable with at least one extreme end of a plurality of the segments in the array or assembly along at least a portion of said predetermined path for moving said segments at least in said portion of said predetermined path, wherein the support and guide means include guide track means (14); and lifting means (11, 60, 61) engageable beneath the segments for slightly lifting the segments from the guide track means to reduce friction of the segments with respect to the guide track means.

21. The system of claim 20, wherein the transport means comprises an endless transport device including at least one endless belt, chain, sprocket belt or gear belt, having an upper run and a lower run extending at least in part along said portion of the predetermined path, and wherein one of the runs of said transport device is engageable with an extreme end of the segments.

22. Folded sheet transport system, particularly folded sheets received from printing machinery, said folded sheets defining a fold line or spine, comprising a plurality of carrier segments (1) defining upper and lower regions and connected alternately at the upper and lower regions to form a segment array or assembly of zig-zag or accordion or bellows pleat form capable of being selectively, in longitudinal direction of the array or assembly, resiliently spread apart or expanded and compressed, and supporting the folded sheets by engagement with the fold line or spine and, upon spreading apart of said segments, likewise spreading the folded sheets supported by the segments;

support guide means (10, 11, 14, 60, 62) for supporting said connected segments and for guiding said supported segments in a predetermined path;

transport means (10, 23, 56) located at and engageable with at least one extreme end of a plurality of the segments in the array or assembly along at least a portion of said predetermined path for moving said segments at least in said portion of said predetermined path, in combination with folded sheets supported by engagement of the carrier segments with the fold line or spine of the sheets, said system including means (38, 39) for retaining the folded sheets and spread-apart condition within the segments, said retaining means (38, 39) comprising converging spring clips secured to the upper regions of the carrier segments.

* * * * *